US007640740B2

(12) United States Patent
Hoshino et al.

(10) Patent No.: US 7,640,740 B2
(45) Date of Patent: Jan. 5, 2010

(54) STIRLING ENGINE

(75) Inventors: Takeshi Hoshino, Chofu (JP); Teruyuki Akazawa, Shiga (JP); Koichi Hirata, Mitaka (JP); Masakuni Kawada, Mitaka (JP)

(73) Assignees: Japan Aerospace Exploration Agency, Tokyo (JP); Panasonic Corporation, Osaka (JP); National Maritime Research Institute, Tokyo (JP)

( * ) Notice: Subject to any disclaimer, the term of this patent is extended or adjusted under 35 U.S.C. 154(b) by 670 days.

(21) Appl. No.: 10/577,804

(22) PCT Filed: Oct. 29, 2004

(86) PCT No.: PCT/JP2004/016135

§ 371 (c)(1),
(2), (4) Date: Apr. 28, 2006

(87) PCT Pub. No.: WO2005/042958

PCT Pub. Date: May 12, 2005

(65) Prior Publication Data

US 2008/0282693 A1 Nov. 20, 2008

(30) Foreign Application Priority Data

Oct. 30, 2003 (JP) ..... 2003-371147

(51) Int. Cl.
*F01B 29/10* (2006.01)

(52) U.S. Cl. ..... 60/523; 60/524; 60/526

(58) Field of Classification Search ..... 60/517–526
See application file for complete search history.

(56) References Cited

U.S. PATENT DOCUMENTS 5,050,570 A * 9/1991 Thring ..... 123/556

FOREIGN PATENT DOCUMENTS

JP 2003-214717 7/2003

OTHER PUBLICATIONS

International Search Report mailed Dec. 7, 2004 of International Application PCT/JP2004/016135.
Notification of Transmittal of Translation of the International Preliminary Report on Patentability (Form PCT/IB/338) of International Application No. PCT/JP2004/016135 mailed Aug. 3, 2006 with Form PCT/IPEA/409.

* cited by examiner

*Primary Examiner*—Hoang M Nguyen
(74) *Attorney, Agent, or Firm*—Westerman, Hattori, Daniels & Adrian, LLP

(57) ABSTRACT

A high efficient stirling engine with excellent thermal efficiency, which can increase the heating temperature of a high temperature section, is obtained by preventing the heat from being lost in a member connecting the high temperature section and a low temperature section.

The high temperature section 5 and the member (a regenerator housing 16) connecting the high temperature section and the low temperature section are formed to have a split configuration by using different materials for the each, in which the high temperature section 5 is formed of a heat resistant/high heat conductive material having high heat resistance property and high heat conductivity, the regenerator housing 16 connecting the high temperature section 5 and the low temperature section 7 is formed of a heat resistant/low heat conductive material having low heat conductivity, and the both are bonded integrally to each other to obtain an integral sealed structure.

13 Claims, 3 Drawing Sheets

(a)

(b)

STIRLING ENGINE

TECHNICAL FIELD

The present invention relates to a stirling engine, and particularly to a stirling engine for achieving high efficiency.

BACKGROUND ART

Theoretical thermal efficiency of a stirling engine is determined by the temperature of a high temperature section and of a low temperature section, and the higher the temperature of the high temperature section and the lower the temperature of the low temperature section, the higher the thermal efficiency is. The stirling engine is a closed cycle engine, and heats/cools working gas from the outside, thus heating and cooling of the working gas need to be performed through a wall surface of the high temperature section and of the low temperature section, and further a material of high heat conductivity is required in order to increase heat exchange rate of the high temperature section and of the low temperature section. As the working gas, helium gas or hydrogen gas is normally used. Since the working gas circulates at high pressure, a flow path for the working gas is required to have heat resistance property, pressure tightness, oxidation resistance, corrosion resistance, high creep strength, and high heat fatigue strength. For this reason, as a heater tube configuring a cylinder and high-temperature side heat exchanger, there has been conventionally used heat-resistant alloy steel such as HR30 (Japanese Industrial Standards), SUS310S (Japanese Industrial Standards), Inconel (trademark), Hastelloy (trademark), and the like having excellent corrosion resistance and heat resistance properties, but there is a problem that these alloy steels are extremely expensive. Moreover, in such a case, the members configuring the high temperature section, and the members subjected to high temperatures by receiving heat from the high temperature section are subjected to limitations in heating temperatures, depending on metallic materials. For example, under a high-pressure condition in which the pressure of operation gas reaches 3 MPa, it is considered that the limit of the heating temperature is approximately 700° C. from the perspective of durability, due to the occurrence of a creep of abovementioned metallic materials, hence it is difficult to achieve high efficiency if the heating temperature is increased higher than the limit.

Further, in a conventional stirling engine, it is necessary to create the high temperature section by weldbonding a number of heat-resistant alloy tubes, through which working gas passes, to an expansion space head portion by means of brazing so as to allow the heat-resistant alloy tube to protrude, in order to obtain more heat transmission areas. However, leakage of the working gas may occur due to a seal failure, and, since a number of heat-resistance alloy tubes are required, the structure becomes complicated and the cost becomes high.

On the other hand, in the member for connecting the high temperature section and the low temperature section in the stirling engine, an end of the high temperature section is required to maintain high temperature and an end of the low temperature section is required to maintain low temperature to keep a large temperature difference therebetween, and the high temperature of the high temperature section and the low temperature of the low temperature section are close to each other, thus it is desired that members having high adiathermanous and low heat conductivity be used to configure the stirling engine. However, in the conventional Stirling engine the member for connecting the high temperature section and the low temperature section is integrally configured with a high temperature section composed of high-nickel alloy or a stainless material having excellent heat resistance property and heat conductivity, thus there is a problem that a large heat loss occurs due to conduction of heat through a member wall connecting the high temperature section and the low temperature section.

As described above, the material configuring the high temperature section is required to have excellent heat resistance property, and also required are contradictory characteristics such that the member for connecting the high temperature section and the low temperature section has, on the one hand, high heat conductivity and, on the other hand, low heat conductivity from the perspective of high efficiency. However, in the conventional stirling engine structure it is impossible to satisfy such contradictory requirements simultaneously, thus either one of the requirements has to be sacrificed.

As a method for increasing the thermal efficiency of the stirling engine in view of such technological background, for example, there is proposed a method in which a level difference is applied in a center position of a U-shaped bent portion of each of two adjacent heater tubes of a plurality of U-shaped heater tubes which perform heat exchange between combustion gas and working gas of a combustor, whereby a space of even width between the U-shaped tubes is secured at all times without allowing the U-shaped tubes to interact with each other even if receiving thermal stress or external pressure, and the high-temperature combustion gas can be evenly allowed to contact with the U-shaped tubes to increase the heat exchange efficiency of the high temperature section (see the patent document 1). There is also proposed a method in which a compression space and an expansion space are connected to each other by a plurality of connecting tubes, a low temperature section, a regenerating portion, and a high temperature section are disposed sequentially in each of the connecting tubes, and, by freely changing specification of the regenerating portion and of the low temperature section in accordance with the distribution of the temperatures of the high temperature section, the engine power is improved (see the patent document 2). Furthermore, there is proposed another method in which a high temperature section, a regenerator, and a low temperature section are surrounded by a double shell, and an incompressible heat insulating material such as liquid chlorine is filled into the double shell, whereby operating temperature and pressure are increased, efficiency of the regenerator is improved, and the number of times that heat is transferred in a direction perpendicular to the direction of flow of working fluid is increased (see the patent document 3).

Patent document 1: Japanese Patent Application Laid-open No. H5-172003

Patent document 2: Japanese Patent Application Laid-open No. H6-280678

Patent document 3: Japanese Unexamined Patent Publication No. 2001-505638

DISCLOSURE OF THE INVENTION

Problem to be Solved by the Invention

Any of the abovementioned methods that have been conventionally proposed in order to increase the thermal efficiency of the stirling engine contributes to the improvement of the thermal efficiency, but is not yet satisfying.

Therefore, the present invention attempts to obtain a high efficient stirling engine by significantly improving the thermal efficiency and reducing loss of heat conduction compared to the prior art, and, specifically, an object of the present invention is to provide a stirling engine capable of increasing heating temperature of the high temperature section higher compared to the prior art, and preventing large amount of heat from being lost in the member connecting the high temperature section and the low temperature section, thereby achieving high efficiency.

Means for Solving Problem

A stirling engine of the present invention which solves the abovementioned problems is characterized in that a high temperature section and a member connecting the high temperature section and a low temperature section are formed of different materials and are integrally bonded to each other to configure the stirling engine, the high temperature section being formed into an integral structure by means of a heat resistant/high heat conductive material having high heat resistance property and high heat conductivity, and the member connecting the high temperature section and the low temperature section being made up of a member which contacts with a flow of working gas, and being formed of a heat resistant/low heat conductive material having low heat conductivity. Furthermore, other stirling engine of the present invention is characterized in that a high temperature section and a member connecting the high temperature section and a low temperature section are formed of different materials and are integrally bonded to each other to configure the stirling engine, the high temperature section being formed by integrally molding an expansion space head portion and a high-temperature side heat exchanger main body with the same heat resistant/high heat conductive material having high heat resistance property and high heat conductivity.

As the heat resistant/high heat conductive material, a ceramics selected from silicon carbide ceramics, silicon nitride ceramics, aluminum nitride ceramics, or alumina ceramics, or a functionally gradient material of these ceramics and metal can be suitably employed. The member for connecting the high temperature section and the low temperature section is preferably formed of a heat resistant/low heat conductive material having low heat conductivity. As the heat resistant/low heat conductive material, a ceramics selected from silicon oxide, cordierite, mica, aluminum titanate, or quartz ceramics, or a functionally gradient material of these ceramics and metal can be suitably employed.

The abovementioned stirling engine is not limited in the shape thereof, thus this stirling engine can be applied to any of a $\beta$ type stirling engine in which a displacer piston and a power piston are disposed in the same cylinder, a $\gamma$ type stirling engine in which a displacer piston and a power piston are disposed independently in different cylinders, or an $\alpha$ type stirling engine having two independent pistons, which are, an expansion piston disposed in an expansion cylinder and a compression piston disposed in a compression cylinder.

Effect of the Invention

According to the present invention of claim 1, the member for connecting the high temperature section and the low temperature section is formed to have a split configuration and the high temperature section is formed of the heat resistant/high heat conductive material having high heat resistance property and high heat conductivity, thus the temperature of the high temperature section can be set higher compared to the prior art. Further, the member connecting the high temperature section and the low temperature section is made up of the member contacting with a flow of working gas, and the member is formed of the heat resistant/low heat conductive material having low heat conductivity, thus heat loss caused by conduction of heat at the connecting member can be reduced significantly, and, as a result, a high efficient stirling engine can be obtained. According to the invention of claim 2, the high temperature section and the member connecting the high temperature section and the low temperature section are formed of different materials and are integrally bonded to each other, and the high temperature section is formed by integrally molding the expansion space head portion and the high-temperature side heat exchanger main body with the same material, which is a heat resistant/high heat conductive material, thus the high-temperature side heat exchanger main body can be integrally formed thickly, can also be provided with a better pressure-tight structure compared to a conventional high-temperature side heat exchanger main body in which only a heat-transfer tube is formed in a protruding fashion, heating temperature of the high temperature section can be raised higher, and the durability can be improved. Furthermore, according to the invention of claim 4, in addition to the configuration of claim 2, the connecting member is formed of the heat resistant/low heat conductive material having low heat conductivity, thus heat loss caused by conduction of heat at the connecting member can be reduced significantly, compared to the prior art, and, as a result, a high efficient stirling engine can be obtained. By forming the high temperature section with a ceramic material having heat resistance/high heat conductivity, and by forming the connecting member with a ceramic material having heat resistance/low heat conductivity, heat resistance property, pressure tightness, oxidation resistance, corrosion resistance, high creep strength, and high heat fatigue strength with respect to the working gas can be enhanced, the heating temperature in the high temperature section can be increased, and the durability can be improved.

EXPLANATIONS OF LETTERS OR NUMERALS

Figure 1:
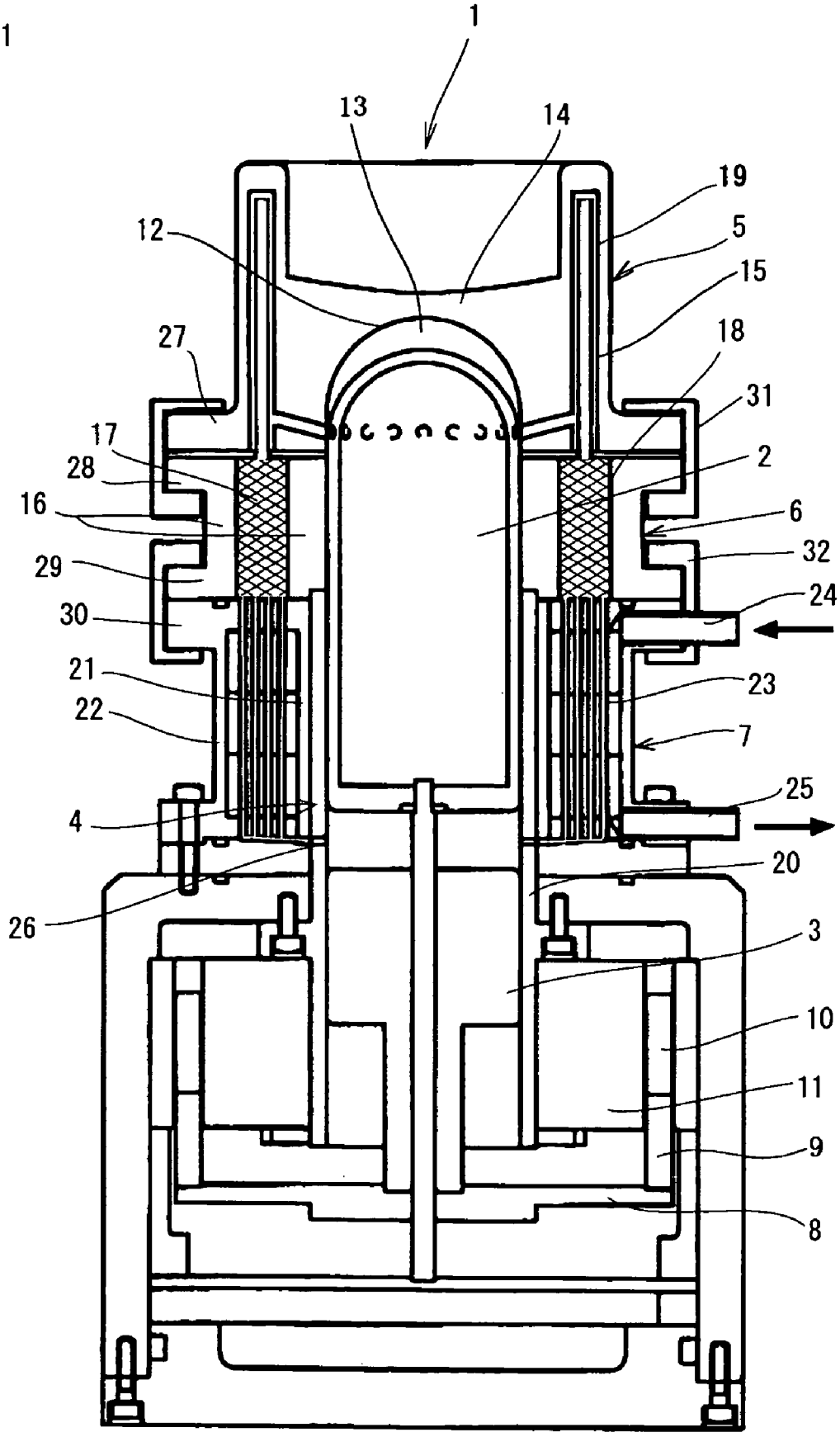
FIG. 1 is a front cross-sectional diagram of the stirling engine according to an embodiment of the present invention.

1, 35, 50: stirling engine
2, 51: displacer piston
3, 52: power piston
4, 53, 58: cylinder
5, 40, 55: high temperature section
7, 43, 57: low temperature section
6: regenerator
10: permanent magnet
11: inner yoke
12: expansion space head portion
13: expansion space
14: high-temperature side heat exchanger main body
15, 44, 60: working gas flow path
16, 41, 56: regenerator housing
20: cylinder main body
21: internal cylinder
22: external cylinder
27, 28, 29, 30: fitting flange
31, 32: clamp

36: expansion piston
38: compression piston
59: compression space

BEST MODE FOR CARRYING OUT THE INVENTION

Hereinafter, the present invention is described in detail with reference to the drawings. FIG. 1 shows an embodiment of the present invention in which the present invention is applied to a β type free-piston stirling engine.

In the figure, 2 is a displacer piston, 3 is a power piston, 4 is a cylinder, 5 is a high-temperature side heat exchanger which is a high temperature section, 6 is a regenerator, and 7 is a low temperature section. The present embodiment shows a case in which electric power is generated by the output power of the power piston 3, wherein a cyclic ring 9 in which a permanent magnet 10 is fixed to a leading end portion thereof is caused to stand up straight on an end portion of an end plate 8 which is fixed to a lower end of the power piston 3, to configure a generator between the permanent magnet 10 and a coil (not shown) fixedly inserted into an inner yoke 11 provided on an outer peripheral portion of the cylinder 4, and the permanent magnet 10 is caused to vertically vibrate by reciprocating motion of the power piston 3, whereby electricity is generated. However, the form of the output power of the power piston 3 is not limited to the above-described pattern, but is applicable to various uses such that the vertical motion of the power piston 3 may be obtained as rotary motion or direct reciprocating motion, and no particular limitation is imposed.

In the present embodiment, in the β type stirling engine 1 having the abovementioned configuration, the cylinder 4, which is slid by the displacer piston 2, is configured with different materials by dividing it to the corresponding portions on, beginning from the top, high temperature section 5, regenerator 6, and low temperature section 7 in succession. The high temperature section 5 comprises an expansion space head portion 12 and high-temperature side heat exchanger main body 14 of the cylinder 4, and is formed by integrally molding it with the ceramic material having high heat conductivity and excellent heat resistance property. An working gas flow path 15 is formed inside the high-temperature side heat exchanger main body 14 in order to heat working gas which moves the regenerator 6 and an expansion space 13, and the working gas passing the working gas flow path is heated by heating the high-temperature side heat exchanger main body 14 from outside. In the present embodiment, as shown in FIG. 1, an after-mentioned heat pipe 19 for connecting the regenerator 6 and the expansion space 13 is fitted to the working gas flow path 15 to configure the high-temperature side heat exchanger, but the working gas may directly move inside the working gas flow path 15 formed inside the high-temperature side heat exchanger main body which is integrally molded with the heat resistant/high heat conductive ceramics.

In the present embodiment, since the high-temperature side heat exchanger main body 14 is formed of the material having high heat conductivity and excellent heat resistance property, the working gas passing through the working gas flow path 15 provided inside the high-temperature side heat exchanger main body 14 can be heated to 1000° C. or higher. According to the present invention, as will be described later, the high-temperature side heat exchanger main body is formed to have an integral structure by providing a number of working gas flow paths therein and integrally molding the working gas flow paths with a ceramics or a functionally gradient material having high heat conductivity and excellent heat resistance property, thus it is not necessary to form a number of heat tubes, through which the working fluid flows into a combustion chamber, into the U-shape and to cause them to protrude to the outside as in the prior art. Furthermore, the configuration of the high-temperature side heat exchanger (heater) can be simplified and the working fluid can be heated up efficiently even when forming the high-temperature side heat exchanger main body thickly, thus the pressure tightness can be improved by forming the high-temperature side heat exchanger main body thickly.

As the material having high heat conductivity and excellent heat resistance property, it is preferred that heat-resistant temperature be at least 750° C. and the heat conductivity be at least 20 W/mK, and a ceramic such as silicon carbide (SiC) ceramics, silicon nitride ($Si_3N_4$) ceramics, aluminum nitride (ALN) ceramics, and alumina ($Al_2O_3$) ceramics, or a functionally gradient material of these ceramics and metal can be suitably employed. The SiC ceramics is excellent in terms of heat resistance property, abrasion resistance, and corrosion resistance, and the intensity thereof is hardly reduced even in a hot temperature of at least 1000° C. Further, by embedding SiC ceramic fiber in the base material of the SiC ceramics to obtain a composite material, a material having combined higher intensity and tenacity can be obtained. The SiC ceramics and ALN ceramics have a heat conductivity of at least 100 W/mK and thus is excellent in heat conductivity and heat resistance property, thus these ceramics are suitable for creating the high-temperature side heat exchanger main body (heater). The silicon nitride ceramics is a material with high covalency and is excellent in mechanical and thermal properties. Particularly, the silicon nitride ceramics is excellent in its intensity, tenacity, and abrasion resistance property, has low expansion coefficient and high heat conductivity (heat conductivity is approximately 20 through 30 W/mK), has extremely good anti-shock property, and can be used even in a high temperature of at least 1000° C. Further, the alumina ceramics has advantages such as having excellent in abrasion resistance property and insulation property, having a high heat conductivity of approximately 30 W/mK, and being relatively cheap.

The regenerator 6 is formed such that wire mesh 17 is fitted in a cyclic wall of a cylindrical regenerator housing 16 at every predetermined interval, and a hole 18 through which the working fluid passes communicates to the working gas flow path 15 of the high-temperature side heat exchanger 14. It should be noted in the present embodiment that a plurality of holes 18 are formed in the regenerator housing 16 at a predetermined pitch so as to be parallel with the shaft center thereof to configure the regenerator, but the regenerator housing can be divided into an internal cylinder as an internal wall surface of the cylinder and an external cylinder, and wire mesh can be fitted into a cyclical hole between the internal cylinder and the external cylinder, thereby forming the regenerator. The regenerator housing 16 is formed of a heat resistant/low heat conductive material. As the heat resistant/low heat conductive material, it is preferable to use a material having a heat-resistant temperature of at least 750° C. and a heat conductivity of 10 W/mK or less, and, for example, silicon oxide ceramics (heat conductivity is approximately 1 W/mK), cordierite ceramics (heat conductivity is approximately 1 W/mK), mica ceramics (heat conductivity is approximately 2 W/mK), quartz glass ceramics (heat conductivity is approximately 1 W/mK), or other low heat conductive ceramics can be suitably used. The intensity of these ceramic material is approximately one fifth of that of stainless, thus the thickness of the regenerator housing 16 needs to be five times thicker, but since the heat conductivity is approximately 1/16 of that of stainless, heat loss caused by heat conduction can be reduced to one third.

Moreover, the material of the regenerator housing 16 is not limited to the abovementioned ceramic material itself, thus it is possible to employ a composite material which is obtained by laminating, for the internal wall side, a ceramic layer having low heat conductivity such as mica, cordierite, zirconia, quartz glass, aluminum titanate or the like, and, for the external wall side, a cheap steel material layer having strong intensity, a composite material which is obtained by spraying the ceramic having low heat conductivity onto the steel material which is the external side or a composite material which is obtained by spraying mica, cordierite, zirconia, quartz glass, aluminum titanate or the like onto the surface of the steel material, which is the external side of the composite material, to form a layer having low heat conductivity on the external wall surface, whereby the regenerator housing 16 can be formed thinner at lower cost. Furthermore, it is possible to use a functionally gradient material in which the components thereof change on the molecular level in the thickness direction such that the internal side surface is configured with the ceramic layer having low heat conductivity and the external side is configured with the steel material.

In the present embodiment, a member from the low temperature section to the part to which the power piston 3 on the lower part slides is formed integrally as a cylinder main body 20, in which an upper outer peripheral portion thereof is provided with an internal cylinder 21 and external cylinder 22 configuring the low temperature section (cooler) 7, a plurality of cooling pipes 23 through which the working gas passes are disposed between the internal cylinder 21 and the external cylinder 22, cooling fluid for exchanging heat with the cooling pipe is caused to circulate via a supply port 24 and an exhaust port 25, whereby the cooler is formed. The material of the cooling pipe 23 through which the working fluid passes may be any materials having heat conductivity and excellent mechanical properties such as stainless metallic material as in the prior art or ceramic materials having excellent heat conductivity, and is not particularly limited to these materials. A lower end of the cooling pipe 23 is communicated to a lower position of the displacer piston 2 inside the cylinder main body 20 via a manifold 26.

As described above, in the present embodiment the displacer piston 2 and the cylinder 4 in which the power piston 3 slides are divided into three components of the cylinder main body 20, regenerator housing 16, and high-temperature side heat exchanger main body 14, thus a seal structure as the joints therebetween is important since the high-pressure working gas does not leak therefrom. The seal structure is explained next.

In the present embodiment, a fitting flange 27 is formed in the high-temperature side heat exchanger main body (heater head) 14, at the same time a fitting flange 28 is formed on an upper end of the regenerator housing 16 so as to be opposite to the fitting flange 27, the both fitting flange 27 and the fitting flange 28 are fixed to each other with a clamp 31, a fitting flange 29 is formed on a lower end of the regenerator housing 16, the space between a fitting flange 30 formed on an upper end of the external cylinder 22 of the low temperature section 7 and a fitting flange 30 formed on an upper end of the internal cylinder 21 of the low temperature section 7 is fixed with a clamp 32, whereby the three are integrated closely. At this moment, the heat may escape from the fitting flange 27 on the high temperature side to the fitting flange 28 on the cooling side, but by providing a seal material such as ceramic fiber or the like having excellent heat resistance property, adiathermanous, and corrosion resistance, on an engaging surface between the both, the number of times the heat is transferred to the regenerator housing is reduced, and sealing performance of the bonded surface can be improved. As the seal material, a packing material formed of the ceramic fiber, or the like can be employed, a putty-shaped amorphous sealing adhesive having high heat resistance property or inorganic adhesive can be employed.

Figure 3:
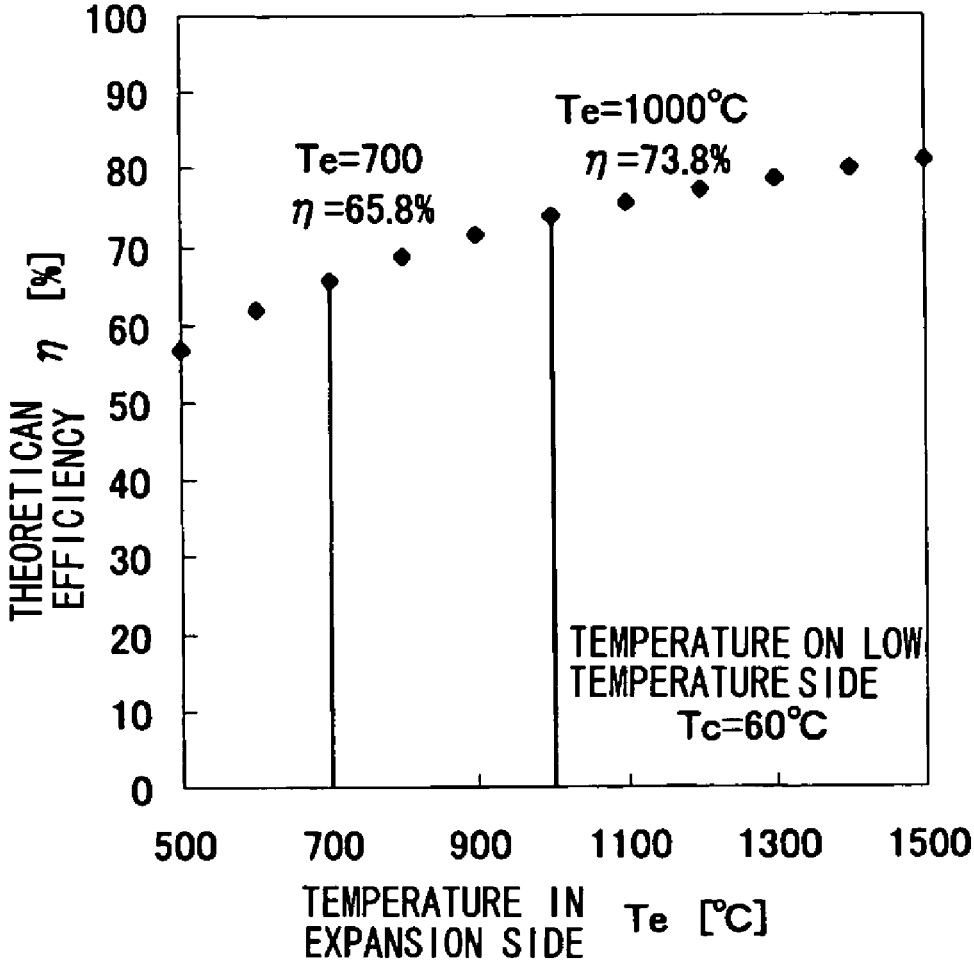
FIG. 3 is a line chart showing the relationship between the expansion space temperature and the theoretical thermal efficiency in the stirling engine.

As described above, in the stirling engine of the present embodiment, by using the ceramics such as silicon carbide (SiC) ceramics, silicon nitride ($Si_3N_4$) ceramics, or alumina ($Al_2O_3$) ceramics, or a composite material or a functionally gradient material of these ceramics and metal on the high temperature side, the expansion space is sufficiently strong even if the expansion space temperature Te is raised to 1000° C., thus, as shown in FIG. 3, when the temperature on the low temperature side is 60° C., the theoretical thermal efficiency can be improved to 73.8%. Therefore, in the case in which the expansion space temperature is 700° C. when using a conventional stainless metallic material, the theoretical thermal efficiency is 65.8%, thus the thermal efficiency can be improved significantly compared to the prior art.

Figure 2:
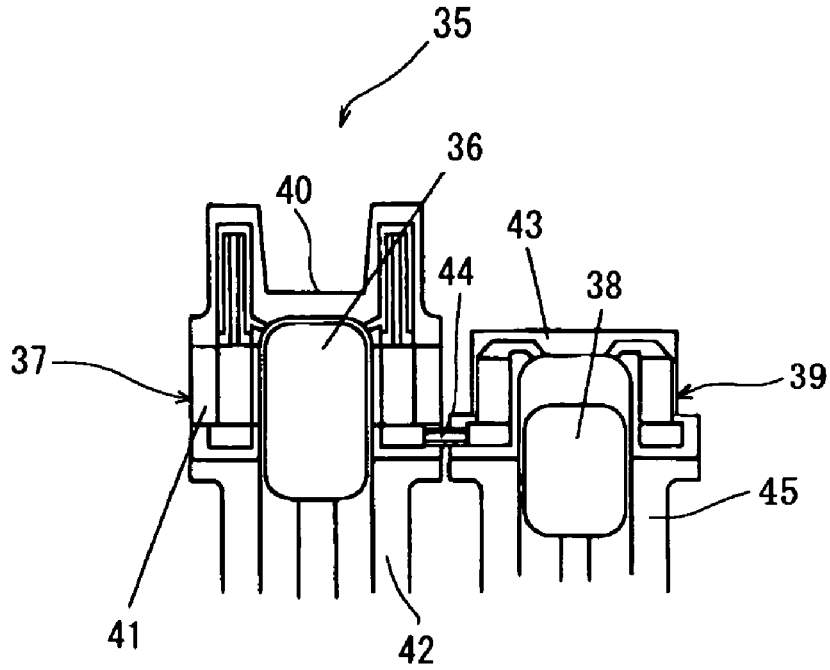
FIG. 2 is a schematic diagram of the stirling engine according to other embodiment of the present invention, in which (a) shows an $\alpha$ type stirling engine and (b) shows a $\gamma$ type stirling engine.
Figure 2:
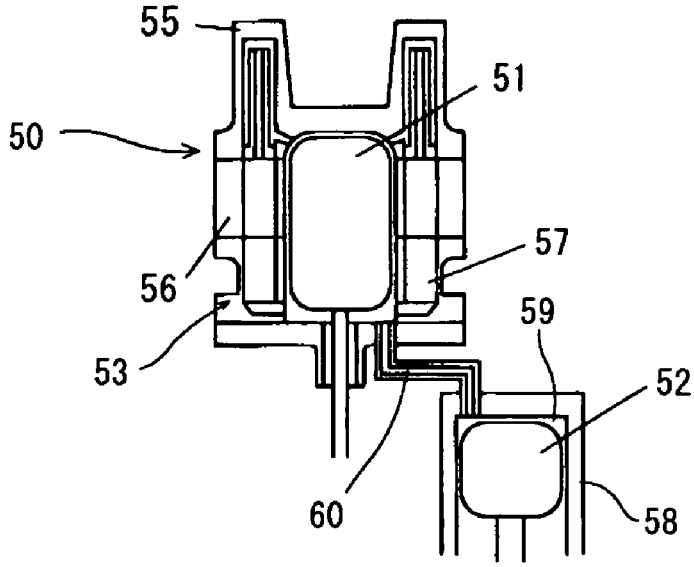

The above embodiment has described a case in which the present invention is applied to the β type stirling engine in which the displacer piston and the power piston are disposed in the same cylinder, but the stirling engine of the present invention is not limited to the β type Stirling engine, but can be applied to an α type or γ type stirling engine. FIG. 2(*a*) schematically shows an embodiment of a case in which the present invention is applied to an α type stirling engine, and FIG. 2(*b*) schematically shows an embodiment of a case in which the present invention is applied to a γtype stirling engine.

The embodiment shown in FIG. 2(*a*) shows an α type Stirling engine 35. In the α type Stirling engine 35, 36 is an expansion piston (power piston) disposed inside an expansion cylinder 37, 38 is a compression piston disposed inside a compression cylinder 39, and the expansion cylinder 37 is integrally configured by forming a high temperature section 40, regenerating housing 41, and expansion cylinder main body 42 with different members. The configurations of the high temperature section 40 and regenerator housing 41 are the same as those of the embodiment described above, and the materials thereof are also the same as those of the embodiment described above, thus detailed explanation is omitted. The compression cylinder 39 is integrally configured by forming a compression piston head portion and a compression cylinder main body 45 with different members, in which the compression piston head portion is a low temperature section 43, and a working gas flow path 44 is formed in the low temperature section, starting from a lower part of the regenerator housing 41 of the expansion cylinder 37, whereby a cooling side heat exchanger is configured.

FIG. 2(*b*) shows a γ type stirling engine 50 of the present embodiment. In the γ type stirling engine 50, a displacer piston 51 and a power piston 52 are disposed in different cylinders. A cylinder 53 in which the displacer piston 51 is disposed, as in the embodiment shown in FIG. 1, comprises a high temperature section 55, a regenerator housing 56 and a low temperature section 57, which are formed of different materials and bonded to each other integrally. Specifically, in a high temperature section 55, an expansion space head portion and a high-temperature side heat exchanger main body are integrally formed of a heat resistant/high heat conductive material, the regenerator housing 56 is formed of a heat resistant/low heat conductive material, and the low temperature section 57 comprises a low-temperature side heat exchanger and formed of a high heat conductive material. An end of the low temperature section is communicated to a compression space via a working gas flow path 60 of a cylinder 58 in which the power piston 52 is disposed.

INDUSTRIAL APPLICABILITY

The stirling engine of the present invention can be used in various fields regardless of the scale of these fields due to its form of the output power. For example, the present invention can be used as a linear generator, compressor, and other rotating engine or direct acting engine, and also can be used as a generator with efficiency higher than that of a solar battery which uses solar energy of space.

The invention claimed is:

1. A stirling engine comprising:

a high temperature section;

a low temperature section; and a member connecting the high temperature section and the low temperature section, wherein the member and the high temperature section are formed of different materials and are integrally bonded to each other, the high temperature section is formed into an integral structure by means of a heat resistant/high heat conductive material having high heat resistance property and high heat conductivity, and the member is formed of a heat resistant/low heat conductive material having low heat conductivity and contacts a flow of working gas.

2. The stirling engine according to claim 1, characterized in that the heat resistant/high heat conductive material for forming the high temperature section is a ceramics selected from silicon carbide ceramics, silicon nitride ceramics, aluminum nitride ceramics, or alumina ceramics, or a functionally gradient material of the ceramics and metal.

3. The stirling engine according to claim 1, characterized in that the heat resistant/low heat conductive material for forming the member connecting the high temperature section and the low temperature section is a ceramics selected from silicon oxide, cordierite, mica, aluminum titanate, or quartz ceramics, or a functionally gradient material of the ceramics and metal.

4. The stirling engine according to claim 1, wherein the stirling engine is a β type stirling engine in which a displacer piston and a power piston are disposed in the same cylinder.

5. The stirling engine according to claim 1, characterized in that the stirling engine is a γ type stirling engine in which a displacer piston and a power piston are disposed independently in different cylinders.

6. The Stirling engine according to claim 1, characterized in that the stirling engine is an α type Stirling engine having two independent pistons, which are, an expansion piston disposed in an expansion cylinder and a compression piston disposed in a compression cylinder.

7. A stirling engine comprising:

a high temperature section;

a low temperature section; and a member connecting the high temperature section and the low temperature section, wherein the member and the high temperature section are formed of different materials and are integrally bonded to each other, and the high temperature section is formed by integrally molding an expansion space head portion and a high-temperature side heat exchanger main body with the same heat resistant/high heat conductive material having high heat resistance property and high heat conductivity.

8. The stirling engine according to claim 7, characterized in that the heat resistant/high heat conductive material for forming the high temperature section is a ceramics selected from silicon carbide ceramics, silicon nitride ceramics, aluminum nitride ceramics, or alumina ceramics, or a functionally gradient material of the ceramics and metal.

9. The stirling engine according to claim 7, characterized in that the member connecting the high temperature section and the low temperature section is formed of a heat resistant/low heat conductive material having low heat conductivity.

10. The stirling engine according to claim 9, characterized in that the heat resistant/low heat conductive material for forming the member connecting the high temperature section and the low temperature section is a ceramics selected from silicon oxide, cordierite, mica, aluminum titanate, or quartz ceramics, or a functionally gradient material of the ceramics and metal.

11. The stirling engine according to claim 7, wherein the stirling engine is a β type stirling engine in which a displacer piston and a power piston are disposed in the same cylinder.

12. The Stirling engine according to claim 7, characterized in that the stirling engine is a γ type stirling engine in which a displacer piston and a power piston are disposed independently in different cylinders.

13. The Stirling engine according to claim 7, characterized in that the stirling engine is an α type Stirling engine having two independent pistons, which are, an expansion piston disposed in an expansion cylinder and a compression piston disposed in a compression cylinder.

* * * * *